US008109181B2

(12) United States Patent
Gao

(10) Patent No.: US 8,109,181 B2
(45) Date of Patent: Feb. 7, 2012

(54) RATCHET SCREWDRIVER AND CONSTRUCTION METHOD

(75) Inventor: Hua Gao, Fox Point, WI (US)

(73) Assignee: Bradshaw Medical, Inc., Kenosha, WI (US)

( * ) Notice: Subject to any disclaimer, the term of this patent is extended or adjusted under 35 U.S.C. 154(b) by 637 days.

(21) Appl. No.: 11/795,963

(22) PCT Filed: May 19, 2006

(86) PCT No.: PCT/US2006/019269

§ 371 (c)(1), (2), (4) Date: Jul. 25, 2007

(87) PCT Pub. No.: WO2007/136365

PCT Pub. Date: Nov. 29, 2007

(65) Prior Publication Data

US 2009/0301267 A1 Dec. 10, 2009

(51) Int. Cl.
*B25B 13/46* (2006.01)

(52) U.S. Cl. ..... 81/62; 81/63

(58) Field of Classification Search ..... 81/61–63.2
See application file for complete search history.

(56) References Cited

U.S. PATENT DOCUMENTS

| | | | | |
|---|---|---|---|---|
| 1,193,716 | A | | 8/1916 | Purssell |
| 1,442,003 | A | | 1/1923 | Rohrer |
| 2,627,330 | A | | 2/1953 | Gantz |
| 4,086,831 | A | | 5/1978 | Smith |
| 4,427,100 | A | | 1/1984 | Rude |
| 4,777,852 | A | | 10/1988 | Herman |
| 5,570,616 | A | * | 11/1996 | Thompson et al. ..... 81/63.1 |
| 5,619,891 | A | | 4/1997 | Tiede |
| 5,848,680 | A | | 12/1998 | Rinner |
| 5,873,288 | A | | 2/1999 | Gauthier |
| 5,943,755 | A | | 8/1999 | Gauthier |
| 5,974,915 | A | | 11/1999 | Chou |
| 6,070,503 | A | | 6/2000 | Shiao |
| 6,282,990 | B1 | * | 9/2001 | Miner ..... 81/57.39 |
| 6,523,439 | B1 | | 2/2003 | Huang |
| 6,543,315 | B2 | | 4/2003 | Huang |
| 6,658,970 | B2 | | 12/2003 | Shiao |
| 6,679,363 | B1 | | 1/2004 | Marchant |
| 6,997,084 | B1 | | 2/2006 | Gao |
| 7,014,023 | B1 | | 3/2006 | Gauthier |

* cited by examiner

*Primary Examiner* — Debra S Meislin
(74) *Attorney, Agent, or Firm* — Absolute Technology Law Group, LLC

(57) ABSTRACT

A ratchet screwdriver with an assembly of a handle (10), a body (17), a gear (56), a pawl (21, 22, 71), and a selector (27) movable on the assembly. The selector carries a pawl actuator (38, 81) for pivoting the pawl, and there is a rotation lock (42, 92) on the selector for releasably holding the rotated selector. The selector can be axially, and also rotationally, movable on the body for controlling the lock. The assembly is along an axis (A), and there are a member (44) and axial force appliers (62, 64) effective between the body and the member, thus restricting axial movement in the assembly. There is provision for assembly along the axis from adjacent the handle. There are modifications and an assembly method.

10 Claims, 5 Drawing Sheets

RATCHET SCREWDRIVER AND CONSTRUCTION METHOD

This invention relates to ratchet screwdrivers and their construction methods.

BACKGROUND OF THE INVENTION

Ratchet screwdrivers are already known in the art of applying a ratchet tool for rotating a threaded fastener such as a screw. Those prior tools can be applied in both the tightening and removing processes of the threaded fastener, including use in the medical arts.

The present invention improves upon the prior screwdrivers in that it provides a ratchet screwdriver that has pivotal pawls and that provides for optimum control and operating confinement of the pawl or pawls, and the drive direction selector, and the driven gear. That produces greater precision in operation.

The pivotal pawl or pawls are snugly mounted and cooperate with the adjacent parts of the screwdriver to be accurate and secure in both the operative and inoperative positions. The selector, which operates the pawl or pawls, cooperates to lend support in both the pawl operative and inoperative positions, and it is releasably lockable in all its two or three selectable positions of operations, and it thereby secures the pawls in their selected operative and inoperative positions.

In achieving the foregoing, the screwdriver is structured and made in a manner that provides for the aforementioned features. It is constructed such that it can be assembled from its back end, rather then from the front end as with the prior art structures. The assembly imposes an axial force on the mechanism for snug containment of the ratchet. Also, it is secured by an axially movable rotation locking member and by fasteners. In that arrangement, the fasteners apply axial force on the assembly and on the drive gear for stabilizing the gear and avoiding the play of the prior art assemblies.

DESCRIPTION OF THE PREFERRED EMBODIMENTS AND METHOD

Figure 1:
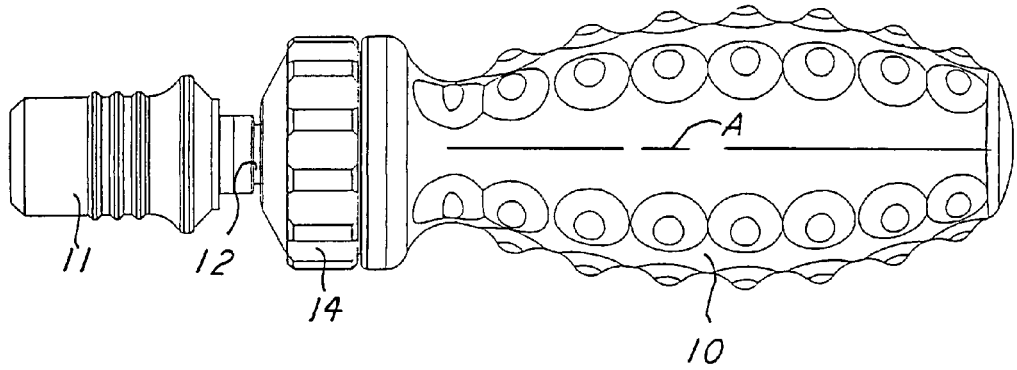
FIG. 1 is a side elevation view of a screwdriver of this invention.
Figure 2:
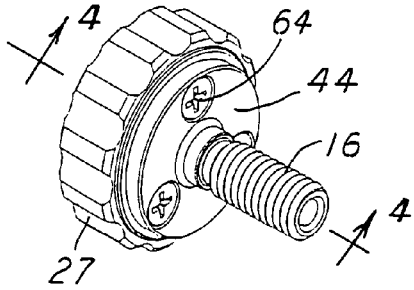
FIG. 2 is a front end perspective view of a fragment of FIG. 1.

FIG. 1 shows a screwdriver of this invention, and it is rotatable about the longitudinal axis A. There is a handle 10 for gripping by the operator, and there is and adapter 11 rotatable by the handle, and it will be understood that the adapter attaches with the handle by having a suitable adapter shank 12 securely threaded into a threaded opening 13 in a ratchet mechanism at 14 which is supported by the handle 10. Likewise, the ratchet 14 has a threaded shank 16 which is suitably conventionally secured in the handle 10. The adapter is conventional in that it receives and drives replaceable tools which are interchangeably releasably held in the adapter. The ratchet 14 determines the direction of rotation of the adapter and its tool about the axis A.

Figure 3:
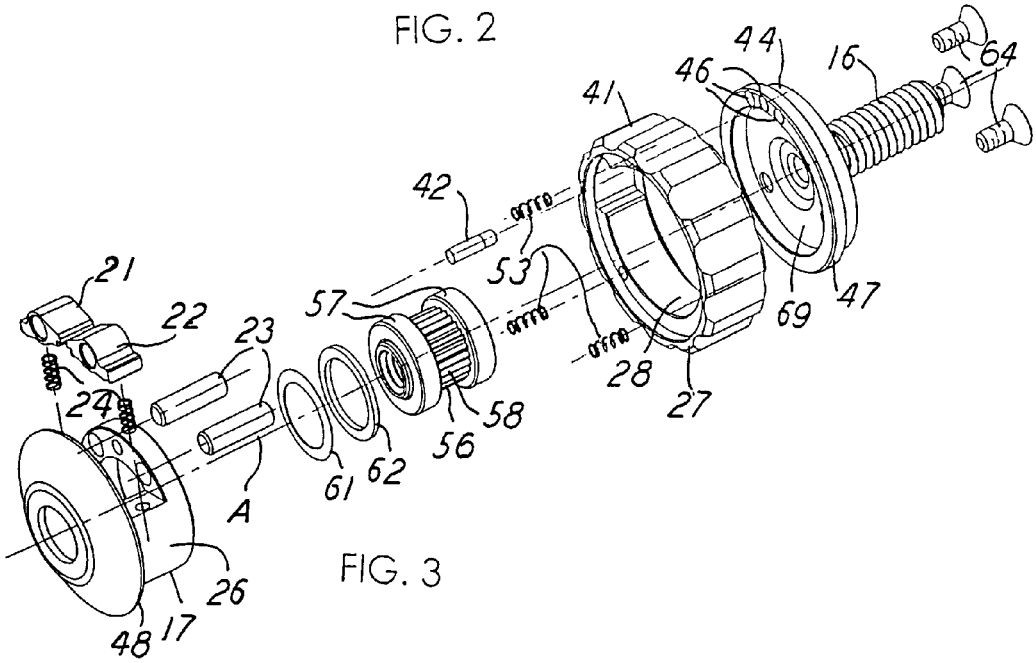
FIG. 3 is a back end exploded perspective view of a fragment of FIG. 1.

The ratchet mechanism 14 in FIG. 3 is viewed from its front end, that is, from opposite the handle end which is the end from which it is assembled, and the assembly achieves a desired no-play axial condition.

A mechanism body, in the form of a pawl cylindrical cage member 17, has a central opening 18 and a cutout 19 which extends to the opening 18 and which pivotally receives two pawls 21 and 22. Pivot posts 23 are secured in the cage 17 and pivotally support the pawls 21 and 22. The cage 17 rotates with the handle rotation and thusly carries the two pawls with it for orbiting about the axis A. A compression spring 24 abuts each pawl 21 and 22 for pivotally positioning the respective pawl.

Figure 6:
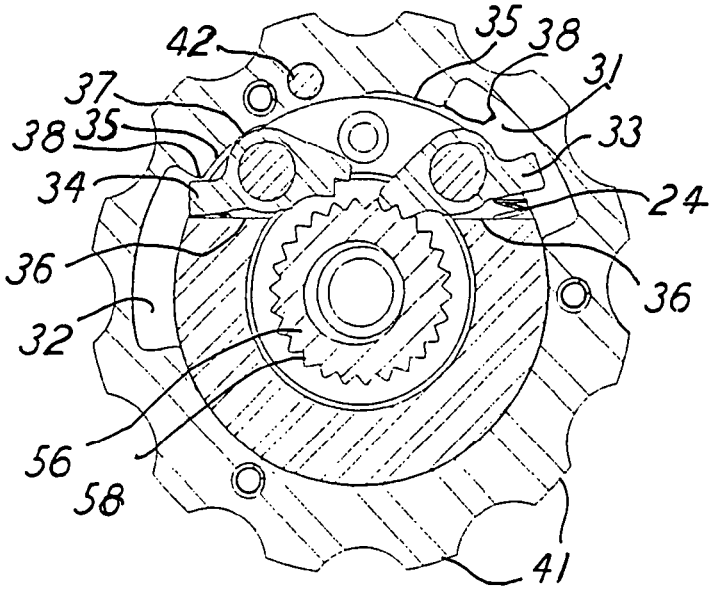
FIG. 6 is a section view taken on a plane designated by the line 6-6 of FIG. 4.
Figure 7:
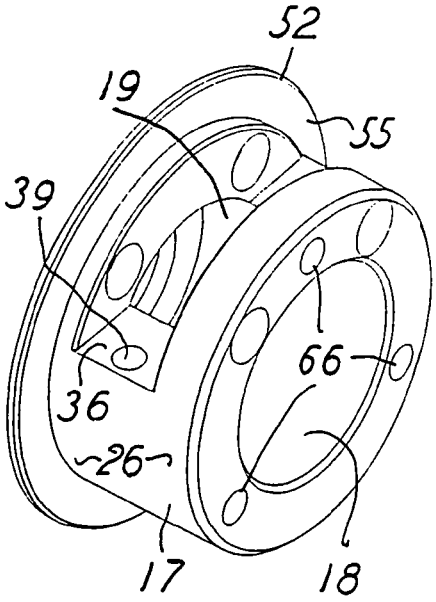
FIG. 7 is an enlarged perspective view of a part shown in FIG. 3.
Figure 8:
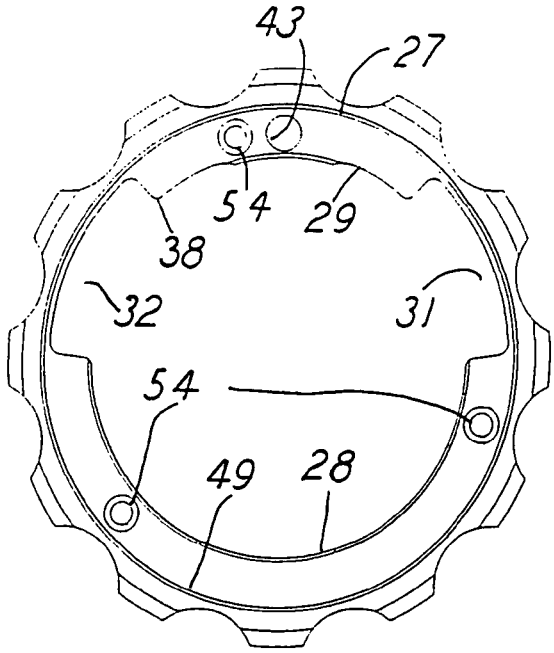
FIG. 8 is an enlarged end elevation view of a part shown in FIG. 3.
Figure 9:
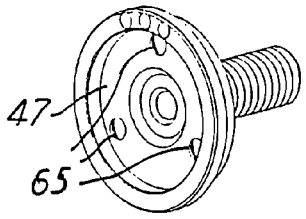
FIG. 9 is a perspective of a part shown in FIG. 3.
Figure 10:
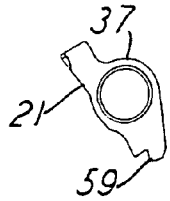
FIG. 10 is a slightly enlarged end elevation view of a part shown in FIG. 3.

The cage 17 has a circular exterior 26, and an annulus or ring 27 is rotatably supported on the surface 26. The annulus 27 is in a complete circle extending around the cage surface 26 and is rotatable thereon. Thus the annulus 27 has interior arcuate surfaces 28 and 29 snug on and guided by the cage surface 26. The annulus also has two radially facing cutouts 31 and 32 which constantly receive the respective projecting pawl ends 33 and 34. It will be understood that the rotation of the annulus will cause engagement of the retilinear. or planar projecting pawl end 33 or 34 and thus pivot the pawl for ratchet selection. The springs 24 can sit in holes 39 on respective tangentially facing surfaces 36 of the cage 17, and the springs 24 urge the pawls into the ratchet engaged mode. It will also be seen in FIG. 6 that the surfaces 36 serve as abutments or stops for the pawls in their disengaged or non-ratcheting mode. Additionally, the annulus 27 has two pockets 35 on its arcuate surface 29 and they can be mated with a matching arcuate surface 37 on the pawls, and the released pawl is thusly confined between the surfaces defining the pockets 35 and the pawl surface 37 in the disengaged mode. Still further, the disengaged pawl is further trapped by the corner 38 of the ring 27, and that can serve as a stop for the rotation of the ring 27 in that direction.

The ring 27 has user-grippable projections 41 for both rotation and axial movement of the ring on the cage 17. In the rotation, the ring 27 can be selectively set in either right hand or left hand, or both, drive direction positions, as with ratchets. In all three positions, the ring 27 can be locked in the selected position and will remain locked until it is axially moved on the cage 17 for unlocking and then moved to another selected position. There is a releasable lock pin 42 that is pressed into the ring hole 43, so the pin 42 moves with the ring 27. Without retraction of the ring 27 and its pin 42, the ring 27 cannot rotate on the cage 17, thus it is locked in one of three selectable positions for the respective ratchet action mentioned. In doing so, the ring is adjacent to and surrounds a circular member 44 which presents three holes 46 for sequential reception of the pin 42.

The member 44 serves as an end locking and axial compression plate for enclosing the rear end of the ratchet mechanism 14 and it presents a circular surface 47 which, along with a circular surface 48 on the cage 17, provides further rotation and axial sliding support, as well as foreign matter rejection, for the ring 27 at two interior circular surfaces 49 on the ring. There is axial space at 51 for the ring 17 to slide axially between the cage 17 and the member 44. The cage 17 is also flanged at 52 for closing off the front end of the ratchet mechanism 14 and providing axial support for three springs 53 which respectively sit in three blind holes 54 in the ring 27 for axially urging the ring 27 into the described pin-locked positions. In operation, the springs 53 slide on the surface 55 of the flange 52 and they extend from the three openings 54 in the ring 27 for axially urging the ring 27, such as rightward as viewed in FIG. 4, and into the selected locked position by pin 42.

A saw tooth gear 56 is rotatably supported, as part of the mechanism 14, on two bearings 57 supported in cage opening 18, and there are radially extending teeth 58 for engagment with the pawls 21 and 22 through the teeth 59 on the pawls. A wave washer 61, along with a plain washer 62, axially presses between a circular wall 60, on an interior flange 63 on the cage 17, and the bearing 57. With a further arrangement, axial movement of the gear 56 in the assembly is eliminated. The annulus 27 has an axial extent along axis A, and the gear 56 and bearings 57 lie within that extent, as seen in FIG. 4.

Figure 4:
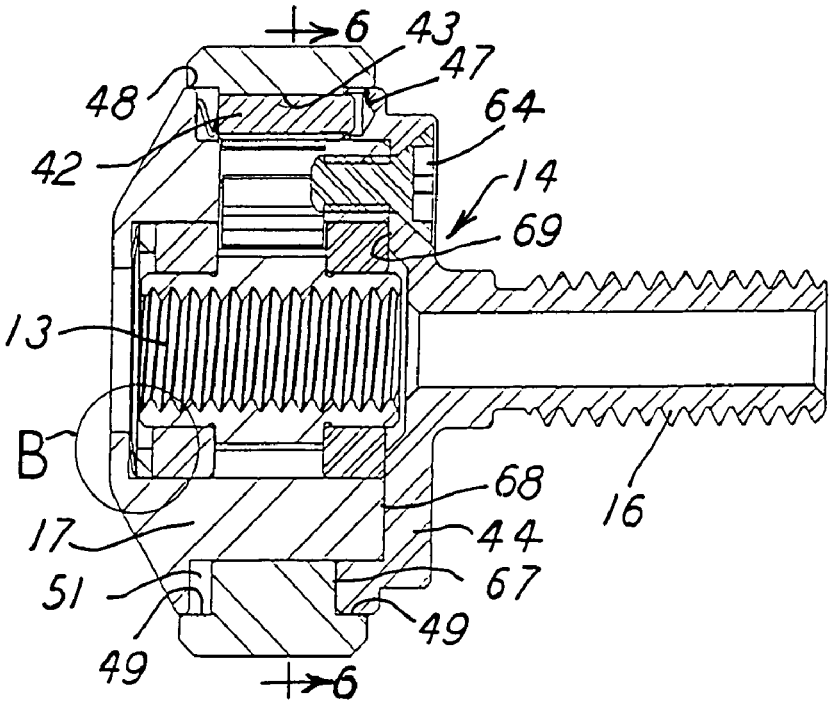
FIG. 4 is an enlarged section view taken on a plane designated by the line 4-4 of FIG. 2.
Figure 5:
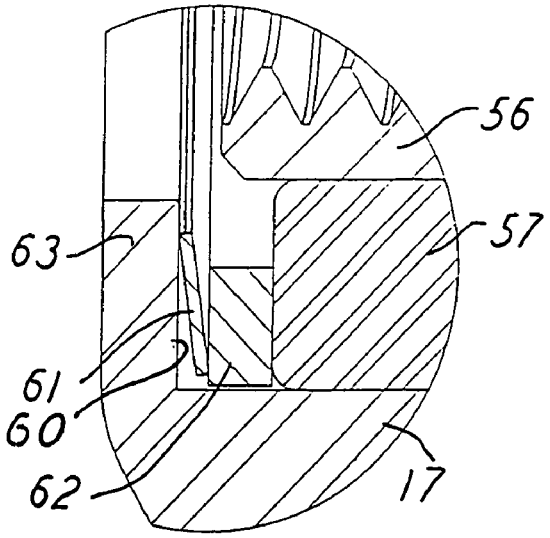
FIG. 5 is an enlarged view of the circled portion designated "B" in FIG. 4.

In the desired assembly from the rear, the parts are brought together along the axis A to the FIG. 4 assembly, and the screws 64 are tightened through the holes 65 in the member 47 and into the cage threaded holes 66. The ring 27 is positioned over the member 17, and the two circular surfaces at 67 and the two at 68 abut each other to achieve snug axial positioning. Likewise, the gear 56 is confined axially through its bearings 57 by the wall 69 on the member 44 and, as mentioned, by the wave washer 61, all by the tightening of the screws 64.

Figure 11:
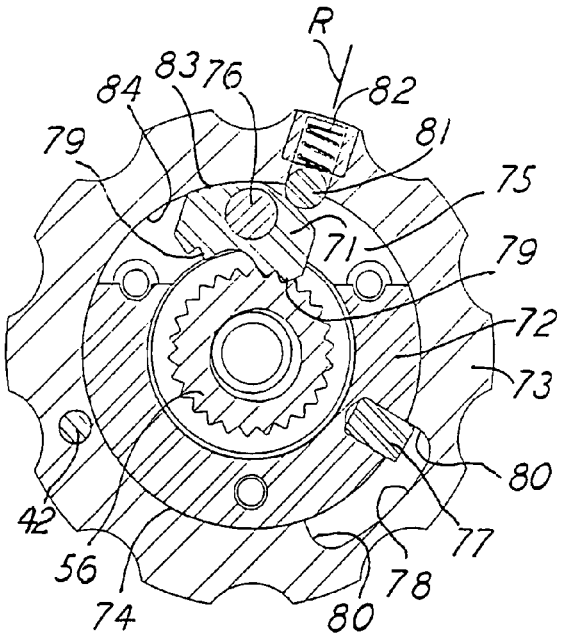
FIG. 11 is a section view similar to FIG. 6 but showing another embodiment of this invention.
Figure 12:
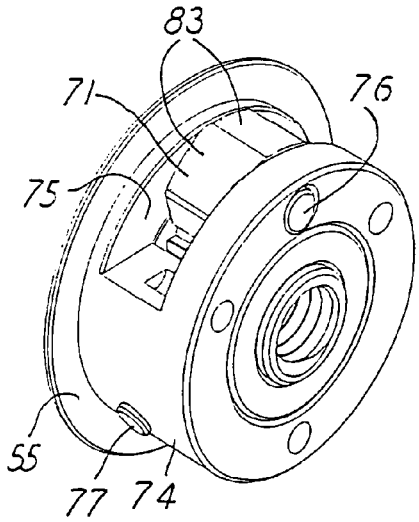
FIG. 12 is a perspective view similar to FIG. 7 but with parts added thereto.

FIGS. 11 and 12 show another embodiment of this invention, and here only one pivotal pawl 71 is employed. The gear 56 is the same, but the body is now a cage 72, and the ring is different from the previous embodiment, and it is now ring or selector 73. Otherwise, the arrangement and the assembly, including the assembly method, are basically unchanged.

The cage 72 has its exterior circular surface 74 for rotational and axial sliding support of the ring 73, and the cage supports a single pivot pin 76 for support of the pawl 71 which extends through the shown cage radial opening 75. Also, there is a rotation stop 77 protruding from the surface 74 for engagement with the ring 73 such as in the recess 78 on the ring where two circularly spaced-apart stop walls 80 are presented to the pin 77.

The pawl 71 has two spaced-apart sets of pawl teeth 79 for alternate engagement with the gear 56. The ring 73 carries a pawl contractor in the form of a ball 81, and a back-up spring 82 is in outer radial restriction on the ring 73 and provides radial inward force on the ball and thus on the pawl. There is sliding engagement of the pawl 71 by the ball for pivoting the pawl between right and left drive engagement with the gear 56 upon rotation of the ring 73. Left hand engagement is shown, and the ring 73 was rotated counterclockwise from that rear handle end to achieve that mode. The pawl 71 has two arcuate and contiguous exterior surfaces 83 which have the same curvature as that of the circular surface 84 of the ring, thus they have the same radius from axis A. Thus the ring lends support for the pawl in both its engaged positions. Also, the ball 81 precisely and easily slides on the arcuate pawl surfaces 83 for its radial movement in and out upon rotation of the ring. Again, the lock pin 42 could be employed and be carried by the ring 73 for the purposes previously mentioned.

FIG. 11 shows that the ball 81 and spring 82 are disposed on a radial line R, and the location of the engaged pawl teeth and the engaged gear teeth is also on that line. That feature occurs in both driving directional modes for the pawl 71, thus there is secure teeth driving arrangement.

Figure 13:
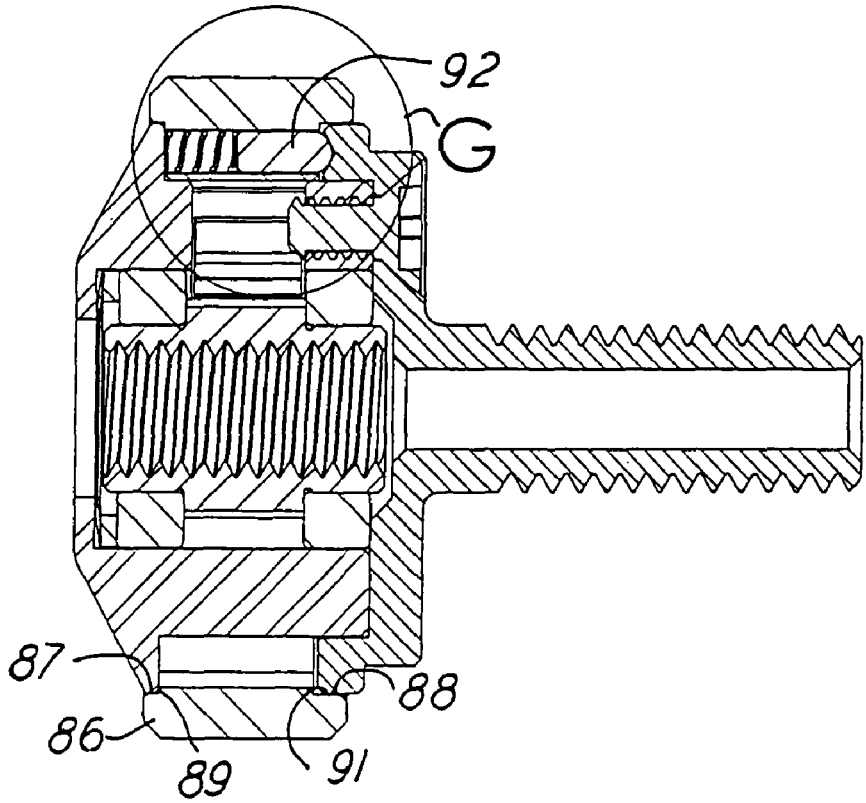
FIG. 13 is a section view similar to FIG. 4 but with a different part, namely, the selector lock.
Figure 14:
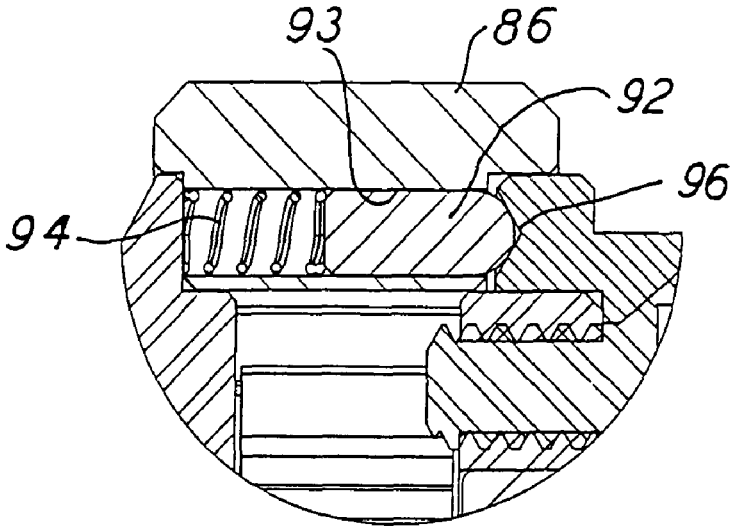
FIG. 14 is an enlarged view of the portion of FIG. 13 in the circle designated G on FIG. 13.

FIGS. 13 and 14 show a modification with regard to the locking of the selectors 27 and 73, and the selector is now slightly changed in its axial length to be selector 86. Thus, the selector 86, which is also termed annulus 86, can be as seen in FIGS. 13 and 14 and has circular surfaces 87 and 88 which are axially guided by and which can be in rotation contact with the adjacent circular surfaces 89 and 91 respectively on the body 17 and the member 44. That is, the selector 86 need not move axially in the assembly. Still, the selector 86 presents a lock pin 92 to the member 44, but the pin 92 itself is axially movably in its mounting hole 93 on the selector 86 for releasable rotation locking with the member 44. A spring 94 urges the pin 92 into the selected one of three holds now 96 in the member 44 for the rotation releasable locking engagement. For the locking action, the pine 92 will ride into and out of the selected hole 96 upon rotation of the annulus 86.

It should be understood that the variations shown in these embodiments are arranged to have each embodiment constructed and operate as intended and indicated. Such as, the three springs 53 are not employed in the embodiment of FIG. 13, and thus the three holes 54 in annulus 27 are not needed. All the embodiments can employ either one or two pawls, as disclosed, and the selector and body can be as appropriate in either FIG. 6 or FIG. 11. The annulus lock pin 42 or 92 and its mounting can be in any embodiment.

The embodiments are described in their construction, and it will be understood that changes can be made therein and still be within the scope of this invention. Further, the showings and the description both disclose the methods for constructing and assembling these screwdrivers.

What is claimed is:

1. In a ratchet screwdriver, a body (17, 72) having a longitudinal axis (A), a gear (56) disposed within the body and rotatable by the handle about the axis (A), a pawl (21, 22, 71) pivoted on the body and being selectively rotationally engageable with the gear, a selector (27, 73) rotatable on the body about the axis (A) to selective rotated positions on the body for engaging the pawl for selective direction of rotation drive, the improvement comprising:

said selector being axially movable on said body, and said body and said selector being selectively relatively non-rotationably engageable for locking said selector in selected rotated positions in response to the axial and rotating movement of said selector.

2. The ratchet screwdriver as claimed in claim 1, further comprising:

a member (44) attached to said body, said member and said selector having a pin (42, 92) extending in the axial direction to be engageable between said member and said selector for achieving the selective locking of said selector on said body.

3. The ratchet screwdriver as claimed in claim 2, further comprising:

said pin being engaged between said selector and said member to have said pin penetrate said member to a depth for the engagement, and said selector being axially movable on said body for an axial displacement in an amount greater than said depth.

4. The ratchet screwdriver as claimed in claim 3, Furth comprising:

a plurality of springs (53) circularly spaced apart relative to said selector and operative between said selector and said body for urging said body axially to an unlocked mode.

5. The ratchet screwdriver as claimed in claim 4, further comprising:

fasteners (64) connected with said member and operative on said body and said springs, wherein said fasteners axially urge said member, said springs and said pin into axial restraint for the selector locking mode.

6. In a ratchet screwdriver, a body (17, 72) having a longitudinal axis (A), a gear (56) disposed within the body and rotatable by the handle about the axis (A), a pawl (21, 22, 71) pivoted on the body and being selectively rotationally engageable with the gear, a selector (27, 73) rotatable on the body about the axis (A) to selective rotated positions on the body for engaging the pawl for selective direction of rotation drive, the improvement comprising:

said body having a surface (60) facing in a first axial direction relative to said axis and on a first axial side of said gear for restricting axial movement of said gear, a member (44) on a second axial side of said gear and being connected to said body for applying axial force along said axis onto said gear to restrict axial movement of said gear relative to said axis and away from said body surface (60), said selector being an annulus and having axially spaced apart interior circular surfaces (49), and said body and said member respectively having circular surfaces (48, 47) in sliding contact with said selector surfaces for movably guiding said selector on said body and said member.

7. The ratchet screwdriver as claimed in claim 6, further comprising:

threaded connectors (64) extending between said body and said member for drawing said body and said member toward each other in applying the axial force therebetween.

8. The ratchet screwdriver as claimed in claim 7, further comprising:

a wave washer (62) adjacent to said gear for axially forcing on said gear in response to tightening of said threaded connectors in the applying of axial force.

9. in a ratchet screwdriver, a body (17, 72) having a longitudinal axis (A), a gear (56) disposed within the body and rotatable by the handle about the axis (A), a pawl (21, 22, 71) pivoted on the body and being selectively rotationally engageable with the gear, a selector (27, 73) rotatable on the body about the axis (A) to selective rotated positions on the body for engaging the pawl for selective direction of rotation drive, the improvement comprising:

said body having a surface (60) facing in a first axial direction relative to said axis and on a first axial side of said gear for restricting axial movement of said gear, a member (44) on a second axial side of said gear and being connected to said body for applying axial force along said axis onto said gear to restrict axial movement of said gear relative to said axis and away from said body surface (60), and said body having a surface (55) disposed to face said handle and said selector being arranged to be axial movable toward said body surface (55) and to present a space (51) adjacent to said body for the axial movement of said selector in the assembled screwdriver.

10. The ratchet screwdriver as claimed in claim 9, further comprising:

said selector being an annulus arranged to be axial movable along said axis toward and onto said body and said member being arranged to contact said annulus for movably supporting said annulus.

* * * * *